United States Patent [19]

Lindsey

[11] 4,104,813

[45] Aug. 8, 1978

[54] MUCK DREDGING MACHINE

[76] Inventor: Duane A. Lindsey, 216 Meadowbrook Rd., Hopkins, Minn. 55343

[21] Appl. No.: 848,347

[22] Filed: Nov. 3, 1977

Related U.S. Application Data

[63] Continuation of Ser. No. 716,141, Aug. 20, 1976, abandoned.

[51] Int. Cl.[2] ..... E02F 3/88

[52] U.S. Cl. ..... 37/57; 37/66; 9/1.2; 415/98; 415/121 B; 241/46.11

[58] Field of Search ..... 241/46.11, 46.17; 415/121 B, 98; 37/66, 65, 64, 57; 9/1.2

[56] References Cited

U.S. PATENT DOCUMENTS

| | | | |
|---|---|---|---|
| 1,840,606 | 1/1932 | Scheffauer | 37/58 |
| 1,909,052 | 5/1933 | Froisland | 415/121 B |
| 3,253,357 | 5/1966 | Allard | 37/65 |
| 3,430,921 | 3/1969 | Dewey | 415/98 UX |
| 3,521,387 | 7/1970 | Degelman | 37/66 |
| 3,709,178 | 1/1973 | Piker et al. | 9/1.2 X |
| 3,738,029 | 6/1973 | Harmon | 37/66 |
| 3,842,521 | 10/1974 | Faldi | 37/57 |
| 3,842,998 | 10/1974 | Borum | 9/1.2 X |
| 3,905,137 | 9/1975 | Gee | 37/66 X |
| 3,958,895 | 5/1976 | Brisson | 415/121 B |
| 3,962,803 | 6/1976 | O'Brien | 37/66 |

FOREIGN PATENT DOCUMENTS

| | | | |
|---|---|---|---|
| 240,859 | 11/1911 | Fed. Rep. of Germany | 415/121 B |
| 216,537 | 7/1968 | U.S.S.R. | 37/66 |

*Primary Examiner*—Clifford D. Crowder
*Attorney, Agent, or Firm*—John W. Adams

[57] ABSTRACT

This is a material dredging pumping machine having a pivoted parallelogram arm structure mounted on a floating barge and includes a pair of axially aligned transversely disposed digging and collecting auger sections carried by said arm structure and combining with a pair of mold board portions to deliver material inward to the intake of a pump unit which pumps the mud through a transporting conduit to a desired remote location, the auger sections and intake portions of the unit including shredding and cutting members specifically designed to cut up solid objects prior to introduction thereof into the pump mechanism.

5 Claims, 13 Drawing Figures

MUCK DREDGING MACHINE

This is a continuation of application Ser. No. 716,141, filed Aug. 20, 1976, now abandoned.

In the past various devices have been developed for dredging and pumping material such as mud for use in dredging and land-fill operations. These have proved to be generally inefficient particularly where obstructions such as logs, fence posts and wire are encountered such as in shallow swampy areas.

It is a general object of the present invention to provide a material dredging and pumping machine particularly adapted for operation in shallow swampy areas and including a floating barge unit having a digging and collecting auger mechanism and a pump mechanism all mounted on an adjustable boom structure mounted on the barge for collecting the material to deliver the same through a transporting conduit to a preselected remote location.

It is another object of the present invention to provide a material pumping machine which is particularly designed to pump mud or muck from relatively shallow swamp areas without substantial interference from solid objects such as logs, fence posts and wire which are frequently encountered in such areas.

It is a further object to provide a mud pumping device mounted on a self-propelled barge adapted to pump substantial quantities of mud at a relatively rapid rate from shallow swamp areas and deliver said mud to the surrounding land area to provide simultaneous dredging and land-fill operations.

It is still another object to provide a swamp dredging and pumping machine which is constructed and arranged to cut up solid objects encountered during the pumping operation and prevent such objects from reaching the impeller mechanism of the pump.

It is a further object to provide a mud or muck pumping machine having a pump mechanism specifically designed to cut up objects which do reach the impeller mechanism.

It is still a further object to provide mud or muck pumping machine which includes a mold board configuration specifically designed to direct the flow of material into the pump intake openings on both sides thereof and increase the velocity of flow at the intake openings and thereby carry an increased quantity of heavier particles in the material while at the same time tending to prevent the larger very heavy objects from reaching the pump openings and designed to permit said larger objects to be quickly and easily dumped whenever the same accumulate on the bottom portion of the mold board.

These and other objects and advantages of this invention will more fully appear from the following description made in connection with the accompanying drawings in which like reference characters refer to similar parts throughout the several views, and in which.

Figure 2:
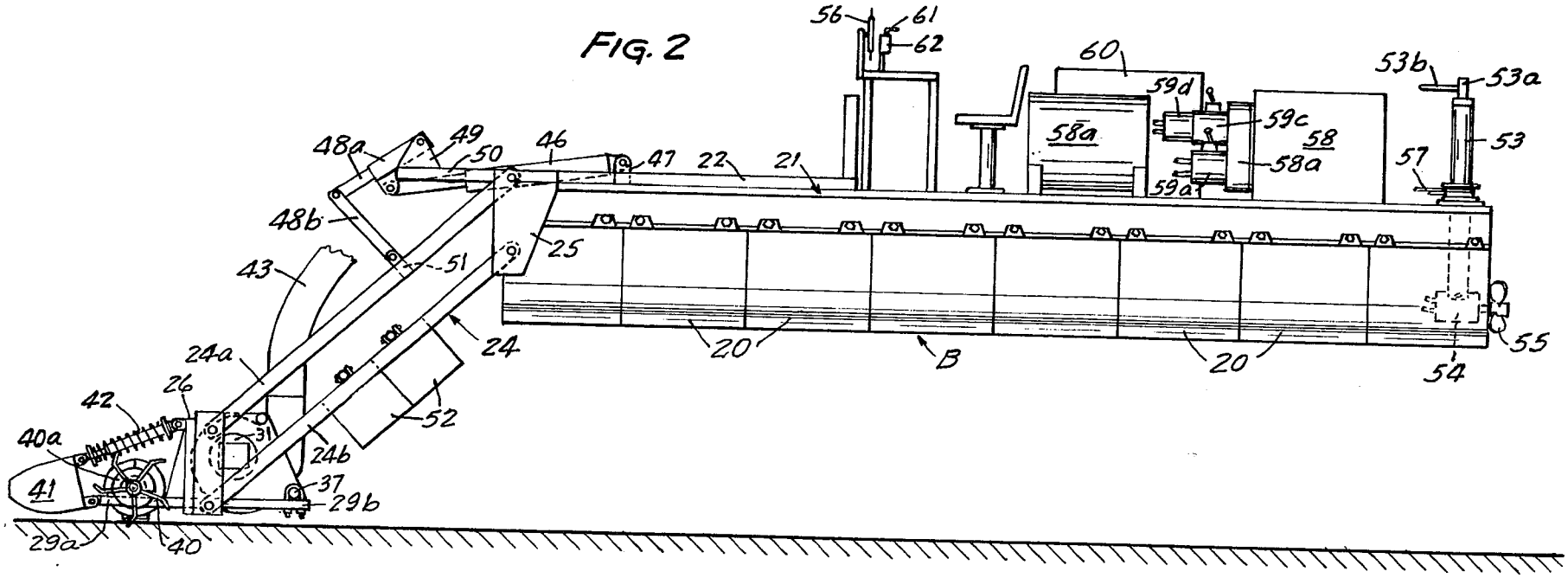
FIG. 2 is a side elevation of the machine shown in FIG. 1.
Figure 7:
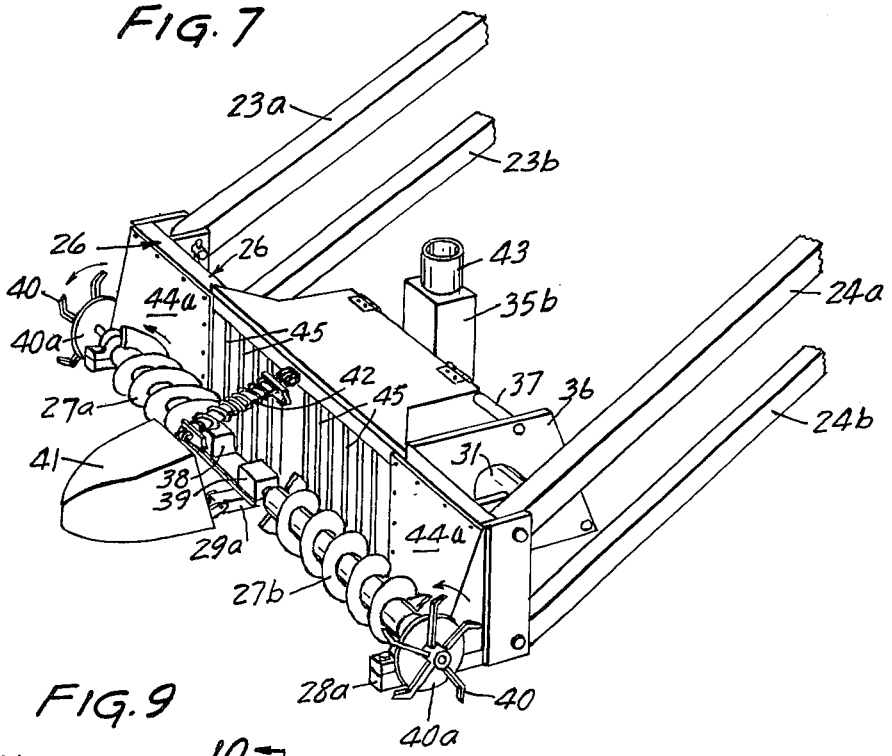
FIG. 7 is a perspective view of the pump and auger assembly.

As illustrated in the accompanying drawings, I provide a floating barge B having a plurality of flotation pontoon sections 20 arranged in three longitudinal rows respectively underlying the center and sides of a deck 21. A pair of spaced apart parallelogram boom arm structures 23 and 24 are pivotally mounted at their rear ends on a rigid frame structure 25 fixed to the front of the barge 3. An upstanding transverse frame structure 26 is mounted across the forward ends of the parallelogram booms 23 and 24, as best shown in FIGS. 2, 4, and 7.

The boom 23 has a pair of parallel boom arms **23*a* and 23*b* and the boom structure 24 has a pair of parallel boom arms 24*a* and 24*b*. In the form shown the mounting frame 26 is a rigid box structure which has a pair of digging and collecting double flight auger sections 27*a* and 27*b* mounted in front thereof. Two pairs of longitudinal mounting beams 28*a*, 28*b* and 29*a*, 29*b* are rigidly connected to the bottom of the transverse frame 26. These beams extend forwardly to mount the respective ends of the auger sections 27*a* and 27*b* and also extend rearwardly to mount a pump unit 30. A cutter bar 27*c* is fixed to the mounting beams and is positioned directly below the augers 27*a* and 27*b*** to shear off material being received by said augers.

The pump 30 is driven by a hydraulic motor 31 through a drive shaft 32 which is journaled in suitable bearings 33 mounted on a bearing support frame 34 which is mounted on the pump housing 35 which, in turn, is rigidly connected to the longitudinal beams **28*b* and 29*b* and the cross frame 26. The motor 31 is supported on a plate 36 rigidly mounted to the frame structure 26 and a plurality of transverse rigid support rods 37 are fixed to the pump housing 35** and to the structure supporting the same.

Figures 3, 4, 5, 6:
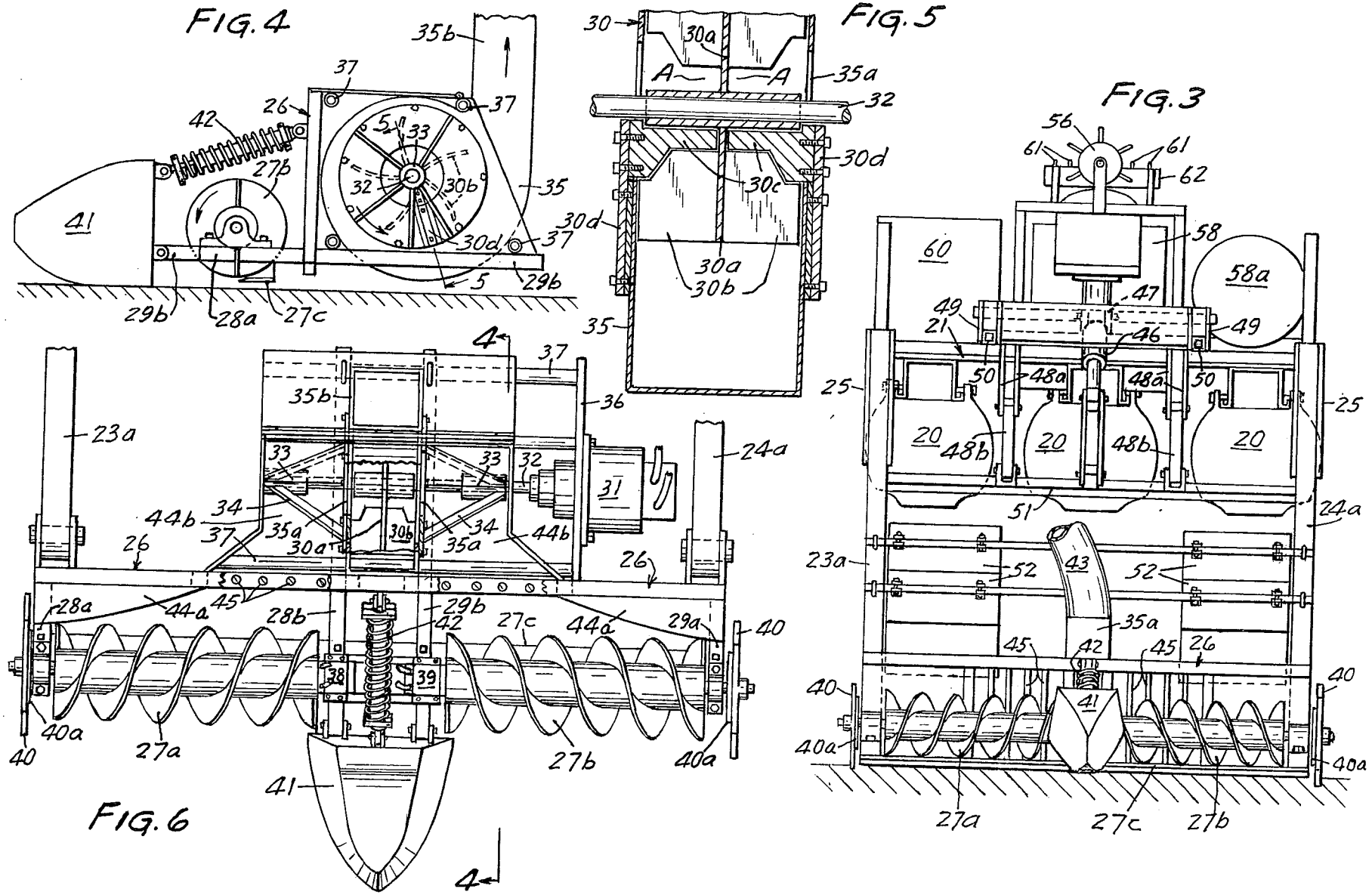
FIG. 3 is a front elevation thereof; with the boom pontoons removed.
FIG. 4 is a fragmentary side elevational view of the pump and auger assembly drawn to an enlarged scale with portions broken away.
FIG. 5 is a transverse sectional view taken substantially along the line 5—5 of FIG. 4 showing the shear blades within the impeller housing of the pump.
FIG. 6 is a fragmentary top plan view of the auger and pump assembly drawn to the same scale as FIG. 4.

The auger sections **27*a* and 27*b* are respectively driven by hydraulic motors separate 38 and 39 which are respectively mounted at the forward ends of the mounting beams 28*b* and 29*b* as best shown in FIG. 6. The auger shafts of sections 27*a* and 27*b* extend laterally outwardly beyond the outer mounting beams 28*a* and 29*a* and have a pair of shredder blades 40 respectively fixed thereto. As illustrated, these shredder blades are respectively carried by mounting discs 40*a* fixed to the ends of auger sections 27*a* and 27*b*** and cut up material being drawn axially into the outer end portions of said two auger sections.

A center plow member 41 has its lower end pivotally mounted at the forward ends of the center mounting beams 28*b* and 29*b* as best shown in FIGS. 4 and 6. The upper portion of the plow 41 is mounted on a spring-loaded collapsible strut member 42 as best shown in FIG. 4. This strut member 42 in the form shown also has a damper or shock absorber unit (not shown) embodied therein.

The pump housing 35 has intake openings 35*a* on both sides thereof and the pump 30 has a central impeller-mounting disc 30*a* fixed to a hub 32*a* which is secured to the shaft 32 for rotation therewith within the pump housing 35 and said disc 30*a* divides said housing into two pumping chambers. Two sets of impeller blades 30*b* are respectively fixed to both sides of said mounting disc for rotation therewith and the inner ends of said blades terminate in radially spaced relation to the drive shaft 32 as best shown in FIG. 4 to provide annular central intake areas A surrounding said hub 32*a* on both sides of said disc 30*a*. In the form shown, the two annular intake areas A are of smaller diameter than the intake openings 35*a* best shown in FIG. 5 and a pair of fixed shearing blades 30*c* of extremely durable material such as hardened steel are securely anchored to the outside of the housing 35 on opposite sides thereof as by the fixed anchor bars 30*d* as best shown in FIGS. 4 and 5. The inner edges of the impeller blades 30*b* have beveled corners and the shearing blades 30*c* are similarly shaped to provide cooperating shearing edges along the inside edge portions thereof when each blade passes thereby, as best shown in FIG. 5. The shearing blades 30*c* thus combine with said impeller blades 30*b* to cut up objects which pass into the intake areas A through the housing intake openings 35*a*. The housing 35 surrounds the disc and impeller blades and completely encloses the same except for the central intake openings 35*a* and the pump discharge outlet 35*b* which is directed upwardly to deliver the material from the pump impeller blades 30*b* under pressure into a transporting conduit 43, whichcarries the material to the desired remote location.

Figure 9:
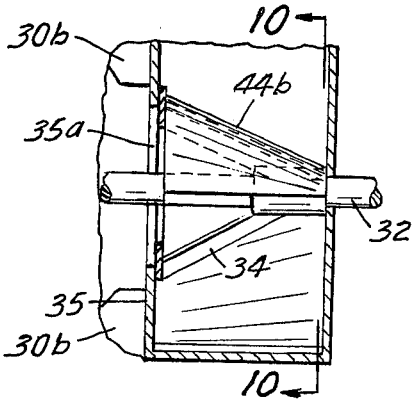
FIG. 9 is a fragmentary top plan view of a portion of the pump with part of the pump housing broken away and showing the material delivery mold board adjacent to the pump housing.
Figure 10:
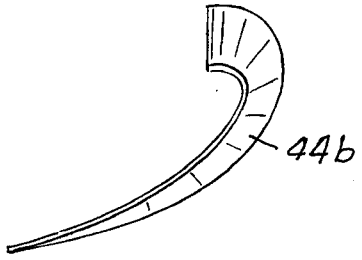
FIG. 10 is vertical sectional view taken substantially along the line 10—10 of FIG. 9.
Figure 8:
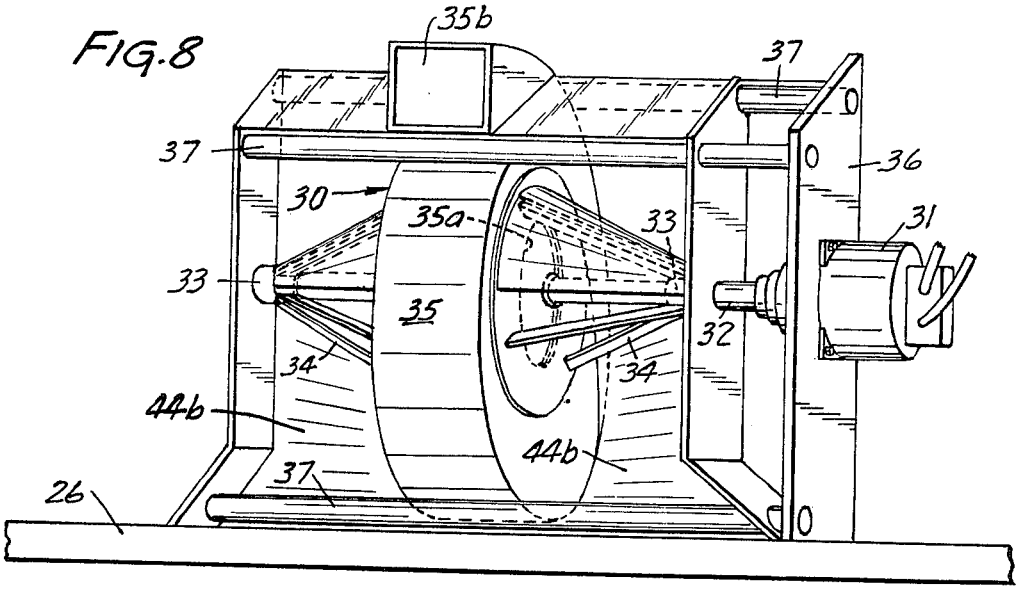
FIG. 8 is a perspective view of the pump housing and mechanism.

A pair of front mold board panels 44*a* are provided at the respective sides of the upright frame structure 26. These mold board panels 44*a* slope slightly upwardly and inwardly, as best shown in FIG. 6. A plurality of upstanding grille bars 45 are fixed between the upper and lower cross frame members of the mounting frame 26 to prevent excessively large objects from reaching the pumping mechanism 30. A pair of inner or rear mold board sections 44*b* extend rearwardly and upwardly from the bottom of the cross frame 26 on each side of the pump housing 35 and are securely anchored to the respective bearing mounting frame elements 34 as well as to the pump housing itself around the respective intake openings 35*a*. The configuration of these mold board sections 44*b* is best shown in FIGS. 8, 9 and 10.

The mechanism for raising and lowering the boom structure includes a hydraulic ram 46 having the rear end pivotally mounted on a fixed rear pivot anchor 47 rigidly secured to the deck 21. The forward end of the ram 46 is pivotally mounted to an upper link structure 48*a* which has its rear end pivotally mounted on fixed pivot brackets 49 which are secured at the forward ends of rigid beams 50 secured to the deck 21 and extending forwardly thereof. The upper arms 23*a* and 24*a* of the parallelogram boom structures 23 and 24 are rigidly connected to each other by a cross beam 51. A lower operating link structure 48*b* is pivotally mounted at its lower end to said cross beam 51 and at its upper end to the forward end of said upper link structure 48*a* as best shown in FIGS. 2 and 3. The lower boom arms 23*b* and 24*b* have a plurality of floats 52 mounted thereunder to provide sufficient buoyance to counterbalance at least a substantial portion of the weight of said digging and pumping mechanism and thus assist the ram 46 in raising boom structure. The hydraulic ram 46 and the connecting linkage are specifically designed so that the boom structure 23 and 24 will not be raised above substantially horizontal position when fully elevated, so that the floats 52 will remain in the water. The booms may be easily lowered to the maximum digging depth at an angle of approximately 60° to the vertical.

Figure 1:
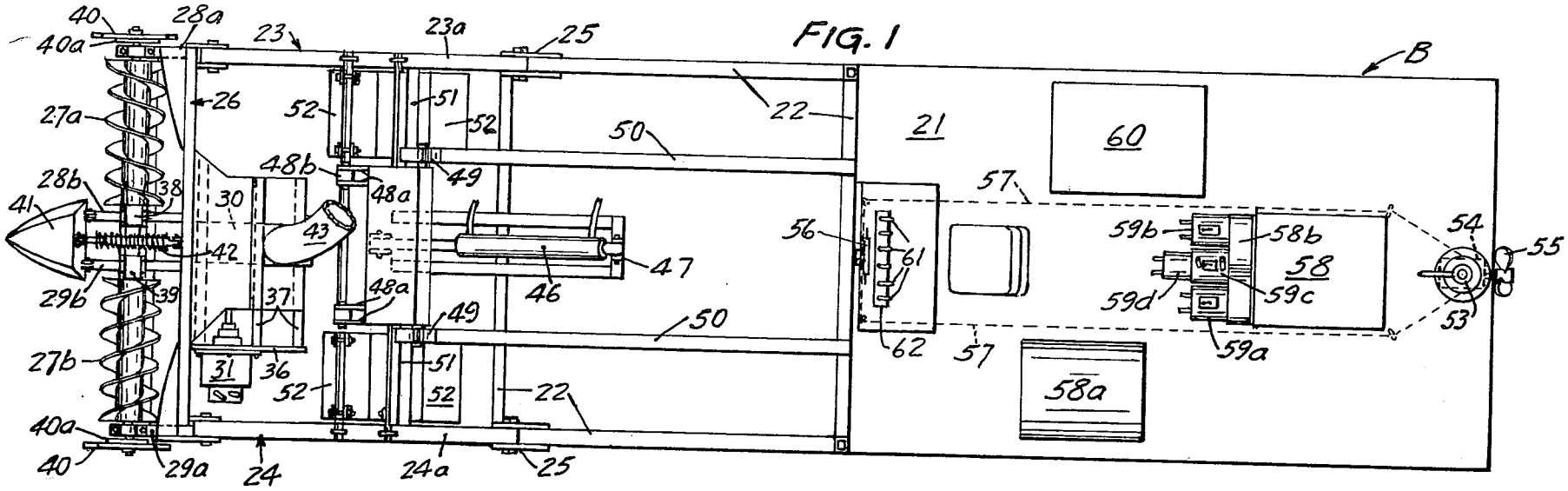
FIG. 1 is a top plan view of a mud dredging and pumping machine embodying this invention.

A barge propelling and steering mechanism is mounted at the rear of the barge B and an upstanding propeller mounting sleeve 53 is rigidly mounted at the central rear portion of the barge with a tiller post 53*a* journaled therein and extending therethrough. A hydraulic motor 54 with a propeller 55 mounted thereon is connected to the bottom of the post 53*a* and a tiller 53*b* is connected to the top of the post 53*a* to steer the same from the rear of the barge. A remote steering mechanism is also provided such as the steering wheel 56 which is connected to the tiller post 53*a* by any suitable means, such as a conventional cable and sheave arrangement 57, shown diagrammatically in FIG. 1.

In the form shown, a single source of power such as the internal combustion engine 58, having a fuel supply tank 58*a*, is provided for driving conventional hydraulic piston pumps 59*a*, 59*b*, 59*c* and gear pump 59*d* through a multiple take off gear box 58*b*. A suitable reservoir tank 60 is provided and connected to the respective pumps. The pump 59*a* supplies hydraulic fluid to the motor 31 of the material pump 30. The hydraulic pump 59*b* supplies hydraulic fluid to the two auger drive motors 38 and 39. The two pumps 59*c* and 59*d* are driven by a common shaft from gear box 58*b*. The pump 59*c* drives the hydraulic motor 54 for the propeller 55. The pump 59*d* which is a gear pump provides fluid for the boom actuating ram 46 through a conventional valve mounted on control panel 62. Suitable individual control valves for the hydraulic motors 31, 38, 39 and 54 are designated as a group by the numerals 61 are mounted on the respective pumps 59*a*, 59*b* and 59*c* and suitable remote controls are mounted on control panel 62 for easy access by the operator and are connected to said valves as by cables (not shown). The individual hydraulic systems to each of the respective hydraulic motors 31, 38, 39 and 54, as well as to the hydraulic ram 46, are all provided in the usual manner with conventional filter elements (not shown) and pressure regulating valves (not shown).

The following is a description of the operation of the pumping mechanism. The booms 23 and 24 are lowered below the surface of the water sufficiently to engage the auger sections 27*a* and 27*b* and cutter bar 27*c* with the bottom of the swamp or lake being dredged. The direction of rotation of the auger sections is selected to pull the entire barge unit B forwardly and the propeller 55 is used to assist the auger sections, if necessary, but is principally provided to provide steerage for the barge unit. The aguer sections dig into the material accumulated on the bottom of the body of water being dredged and deliver this material inwardly from the outboard ends of the augers. The outer shredder blades 40 shear off and cut up objects drawn laterally into the outboard ends of the auger sections.

The center plow member 41 serves to concentrate the material at the inboard ends of the auger flights and to protect the auger motors 38 and 39 from damage by impact with solid objects directly ahead of the barge unit. The forward or outer mold panels 44*a* direct the material inwardly to the openings through the grille bars 45 and the inner upwardly and inwardly sloping mold board sections 44*b* direct the material passed through the grille bars 45 into the pump intake openings 35*a* and the intake chambers A on both sides of the central mounting disc 30*a*. The rotating impeller blades 30*b* then engage the material and discharge the same under pressure out through the discharge outlet 35*b* and into the material transport conduit 43. The stationary shear blades 30*c* combine with the rotating impeller blades 30*b* to shear off and cut up objects that would otherwise wind around the impeller shaft and damage the pump mechanism. The sharply sloping mold board sections 44*b* increase the velocity of material delivered to the intake openings 35*a* of the material pump, while at the same time retarding the movement of excessively large and heavy objects such as rocks and the like which have passed between the grille bars 45 to prevent the same from reaching the openings 35*a* and damaging the pumping mechanism. Since the parallelogram arms of the boom structure 23 and 24 maintain a constant optimum operational orientation of the entire digging, collecting and pumping mechanism mounted thereon, it will be apparent that the forwardly and downwardly sloping mold board sections 44*b* also permit any accumulation of such large objects such as rocks and the like to be easily and quickly dumped by merely raising the unit above the bottom to permit these objects to roll out through the grille sections.

Figure 12:
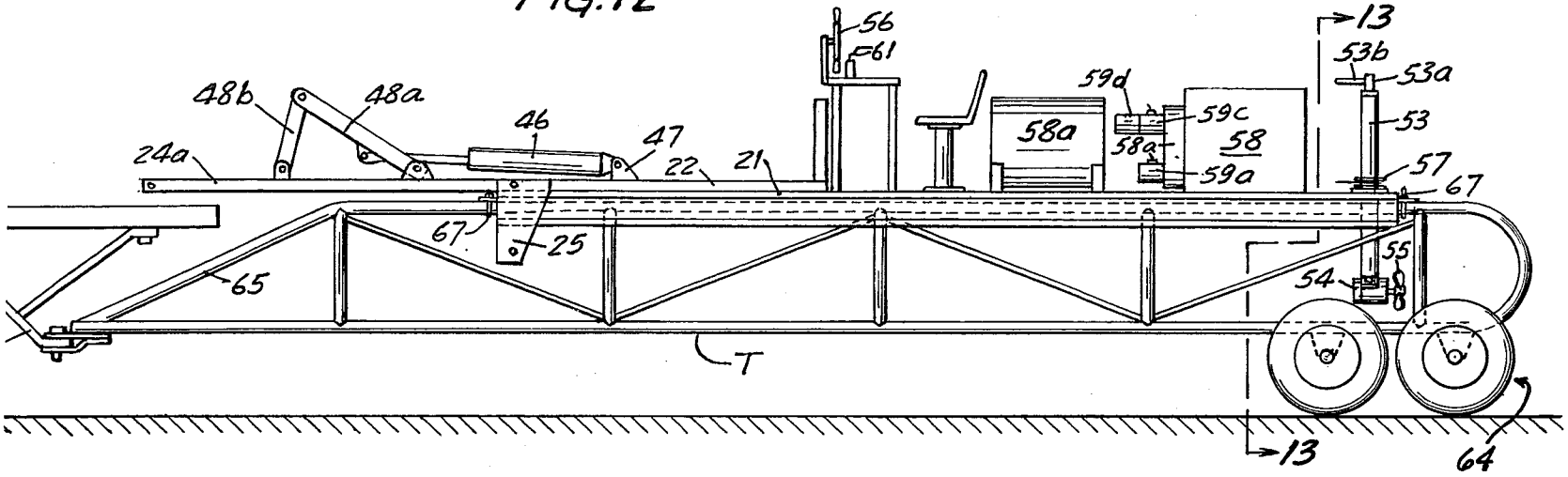
FIG. 12 is a side elevational view of the barge unit mounted on a trailer with the pontoons removed.
Figure 13:
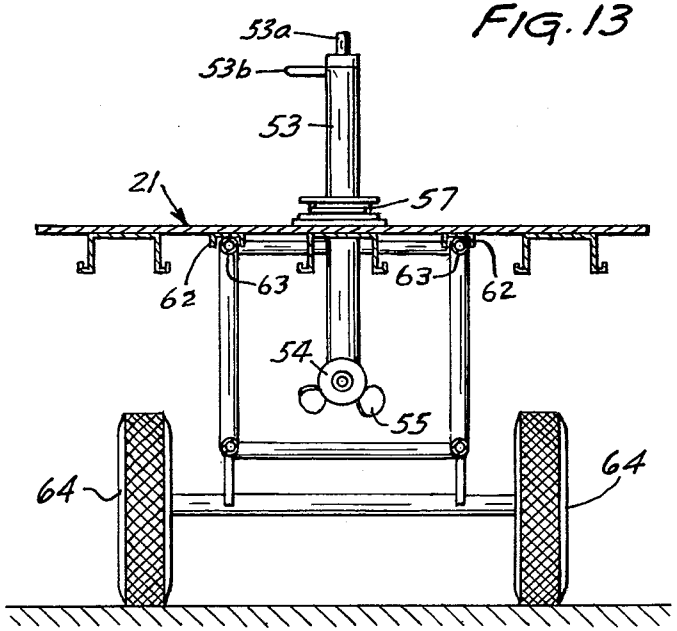
FIG. 13 is a transverse sectional view taken substantially along the line 13—13 of FIG. 12 showing the unit mounted on said trailer.
Figure 11:
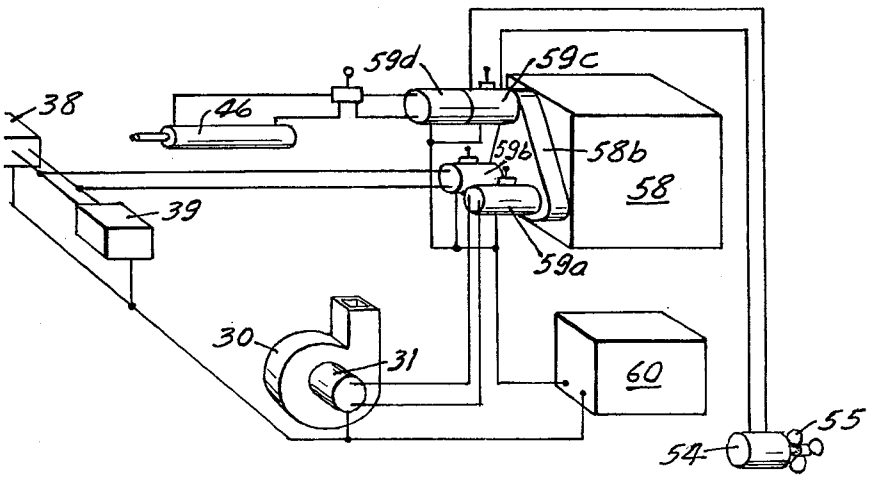
FIG. 11 is a diagrammatic view of a portion of the hydraulic system.

Since the barge is a relatively large and cumbersome unit, we have found that it is necessary to provide a special trailer T to transport the same from one location to another. To facilitate this, the underside of the deck 21 has a pair of spaced apart downwardly facing U-shaped longitudinal channel members 62 disposed between the rows of pontoons 20 as best shown in FIG. 12. These channels extend the full length of the barge and receive a pair of upper rails 63 of the trailer which form a part of a rigid frame structure mounted on suitable trailer wheels 64. The trailer has a draw bar 65 at the front thereof for attachment to a hitch 66 mounted on a truck, only the rear portion of which is shown in FIG. 12. The boom structure is elevated sufficiently to rest on the rear end of the truck bed as illustrated in FIG. 12 or may be detached completely and carried on the truck bed, if desired. To mount the barge on the trailer, the rails 63 are respectively aligned with the channel members 62 and the trailer is backed into the water under the barge as far as possible and thereafter a winch is used to pull the barge forwardly onto the trailer, as shown in FIG. 12. The barge is clamped to the trailer by any suitable means, such as the U-bolts 67 which securely lock the channel members 62 to the upper rails 63 of the trailer.

It will be seen that I have provided a relatively simple yet highly efficient material dredging and pumping machine which is specifically constructed to be easily moved over land from one location to another.

It will, of course, be understood that various changes may be made in the form, details, arrangement and proporations of the parts without departing from the scope of this invention as set forth in the appended claims.

What is claimed is:

1. A machine for dredging and pumping semi-liquid material, the machine comprising:

a floating barge;

a boom structure pivotally mounted on the front of the barge, and extending forwardly therefrom;

first and second laterally disposed mud digging and collecting auger elements co-axially arranged and mounted on the boom structure and delivering a material being dredged laterally inwardly from the outer ends toward the inner ends thereof;

a pumping unit mounted on the boom structure between the first and second auger elements and disposed therebehind to receive the material collected thereby, the pumping unit comprising:

a housing;

a rotary shaft within the housing disposed substantially parallel to the axis of the first and second auger elements;

first and second inlet openings surrounding the rotary shaft on first and second sides of the housing, respectively, to permit material from the inner ends of the first and second auger elements to pass into the housing, the first and second inlet openings being positioned above the elevation of the bottom of the first and second auger elements at all times;

impeller blade means within the housing and connected to the rotary shaft in radially spaced relation;

first and second rear mold boards mounted on opposite sides of the housing for guiding material from the first and second auger elements upward and inward to the first and second openings, respectively, each rear mold board having a lower front edge, an inside edge, an outside edge, an upper edge, and a side plate, the lower front edge being disposed behind one of the auger elements below the axis thereof, the rear mold board sloping generally upwardly and rearwardly from the lower front edge with an upper rear portion of the rear mold board forming a generally frustoconical section, with the upper edge terminating in spaced relation above and behind the lower front edge, thus providing an open material receiving front portion and a closed rear material guiding and collecting portion with the inner edge being connected to the housing of the pumping unit and extending around the inlet opening thereof and conforming generally to the shape of the rear portion of the opening thereof, the outer edge defining a smaller diameter outer portion of the frusto-conical section and being connected to the side plate;

an elongated delivery conduit receiving the material from the pumping unit and transporting the same to a remote location; and means for raising and lowering the boom structure to adjust the elevation of the first and second auger elements and the pumping unit.

2. The structure set forth in claim 1 and further comprising:

first and second collecting mold boards located behind the first and second auger elements, respectively, wherein the first and second collecting mold boards have their inner ends spaced apart to provide a receiving opening between the inner ends of the first and second auger elements and the pumping unit, the first and second rear mold boards being positioned behind the receiving opening to receive material from the first and second auger elements and guide the material upward and inward to the first and second inlet openings; and a plurality of bars forming a restricting grille interposed between the first and second auger elements and the pumping unit proximate the receiving opening to limit the size of solid material passing from the first and second auger elements to the first and second inlet opening.

3. The structure set forth in claim 2 wherein the pumping unit further comprises:

a central divider disc connected to the rotary shaft within the housing unit to define first and second chambers within the housing, wherein the first and second inlet openings permit material from the inner ends of the first and second auger elements to pass into the first and second chambers, respectively, and wherein the impeller blade means is attached to the central divider disc and is positioned within the first and second chambers; and shearing blade means mounted in the first and second chambers and in close association with the impeller blade means to cut up objects entering the first and second chambers through the first and second inlet openings.

4. The structure set forth in claim 1 and further comprising:

a plurality of supporting frame elements fixed to the housing on opposite sides thereof and providing reinforcement of the first annd second rear mold boards.

5. The structure of claim 1 and further comprising:

auger element drive means mounted on the boom structure for driving the first and second auger elements;

plow means mounted on the boom structure and extending forward in front of the first and second auger elements, the plow means being positioned centrally with respect to the first and second auger elements to concentrate material at the inner ends of the first and second auger elements and to protect the auger element drive means from solid objects directly ahead; and shock absorbing means connected to the plow means.

* * * * *